United States Patent [19]

Isaac

[11] Patent Number: 4,487,129

[45] Date of Patent: Dec. 11, 1984

[54] METHODS OF AND CONTAINERS FOR IGNITING EXPLOSIVES

[76] Inventor: Stanley N. Isaac, 6 Falstone Crescent, Ashington, Northumberland N.E. 63 Oty, England

[21] Appl. No.: 539,142

[22] Filed: Oct. 5, 1983

[51] Int. Cl.[3] ..... F42D 3/00

[52] U.S. Cl. ..... 102/313; 102/331; 102/332; 299/13

[58] Field of Search ..... 102/312, 313, 331, 330, 102/332; 299/13; 149/46

[56] References Cited

U.S. PATENT DOCUMENTS

| | | | |
|---|---|---|---|
| 2,835,197 | 5/1958 | Ferguson | 102/333 |
| 3,151,556 | 10/1964 | Karpovitch | 102/333 |
| 3,420,173 | 1/1969 | Slawinski et al. | 102/331 X |
| 4,037,536 | 7/1977 | Griffith | 102/331 X |
| 4,178,852 | 12/1979 | Smith et al. | 102/331 X |
| 4,334,476 | 6/1982 | Day et al. | 102/331 X |
| 4,383,484 | 5/1983 | Morrey | 102/313 X |

*Primary Examiner*—Peter A. Nelson

*Attorney, Agent, or Firm*—James C. Wray

[57] ABSTRACT

The invention provides a container for explosive material comprising a rigid tube (10 FIGS. 1–4, 18 FIGS. 5–8) a closure (13,14; 19,20) at each end of the tube, said tube having a recess (12; 21) in its wall between its ends to receive a detonating cartridge.

5 Claims, 8 Drawing Figures

METHODS OF AND CONTAINERS FOR IGNITING EXPLOSIVES

BACKGROUND TO THE INVENTION

This invention relates to methods of and containers for igniting explosives especially ammonium nitrate andfuel oil (AN/FO).

STATEMENT OF PRIOR ART

AN/FO is commonly required to be used in bore holes in the ground in water bearing strata and for this reason it is usual to contain the AN/FO in polythene bags. These may be as long as the hole e.g. 30 feet. However, these tend to float due to air in the bags which introduces difficulties and may collapse so as not to guarantee adequate contact with the primary explosives needed to initiate ignition of the AN/FO which for safety reasons must be lowered into the hole first. Moreover, polythene bags tend to develop static electricity which is a danger factor when the normal method of filling polythene bags on a shot site is followed. Hitherto it has only been practicable to use the much more costly gelignite or a slurry of AN/FO mixed with gums to make a kind of gel.

SUMMARY OF THE INVENTION

According to the present invention I provide a container for explosive material comprising a substantially rigid tube of plastics material, a recess in the wall of the tube between its ends large enough to house a detonating cartridge, at least two locating means of plastics material rigidly attached to the tube, at least one of said means being on each side of said recess, said means being adapted to locate a detonating line on opposite sides of said recess, and projecting resilient means of plastics material fixed to the outside of the tube and adapted to permit movement of the tube down a bore hole but to engage the walls of the hole to prevent it from floating up, and means for closing the ends of the tube, the capacity of the tube being much greater than the recess so as to be suitable for containing a main charge of explosive.

The effect of the projecting means coupled with the fact that each container is fired with its own individual charge at the same instant as all the other containers in the hole ensures that the explosion takes place where it should be, i.e down the hole. It also reduces air over pressure, a major complaint and also reduces the chances of flyrock dramatically. Also the fact that the containers can be filled the day prior to use and stored in magazines, allows any static electricity generated to dissipate and so eliminate the danger of accidentally firing detonators. The containers cannot float up in a water filled bore hole.

As the bore and recess is completely separate from the space for the AN/FO there is no possibility of water reaching the AN/FO which would neutralize the explosive.

BRIEF DESCRIPTION OF THE DRAWINGS

The invention will be further described by way of example with reference to the accompanying diagrammatic drawings wherein.

DESCRIPTION OF PREFERRED EMBODIMENTS

Figure 1:
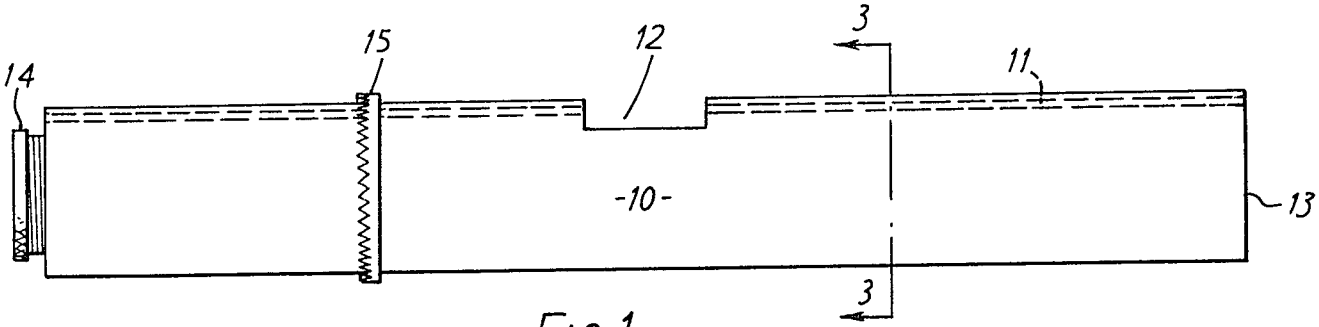
FIG. 1 is an elevational view of a container made in accordance with the invention.
Figure 2:
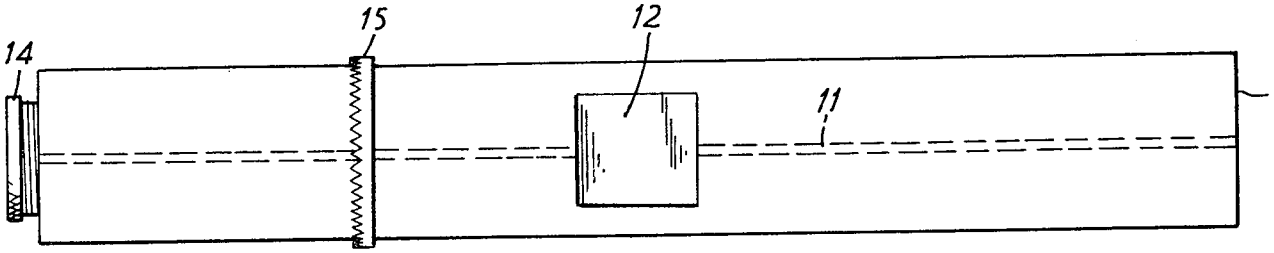
FIG. 2 is a plan view thereof.
Figure 3:
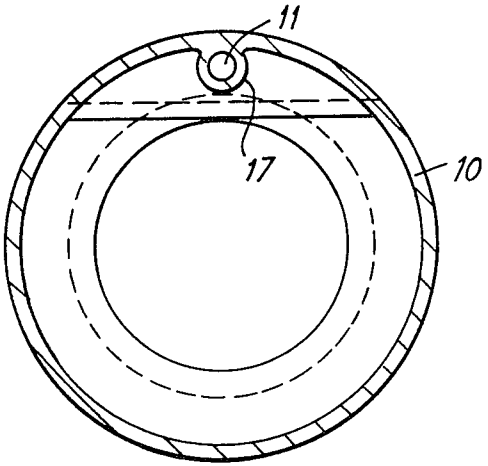
FIG. 3 is a cross-sectional view thereof on the plane 3—3 on FIG. 1.
Figure 4:
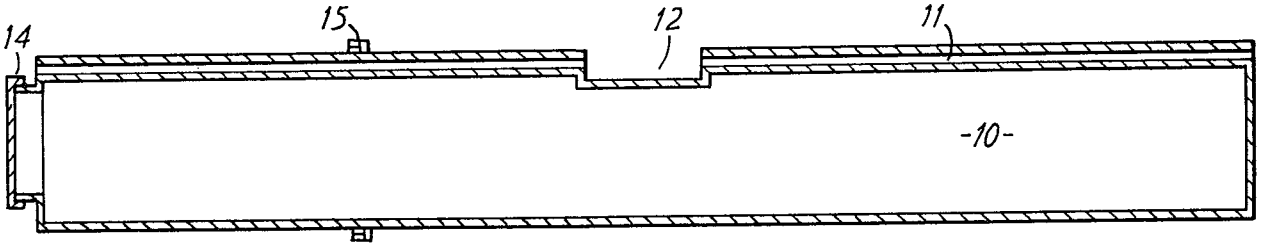
FIG. 4 is a longitudinal section of the container.

The container 10 is made of plastics material which is rigid and may be about B 3–5 mm thick. A bore 11 is made throughout its wall and a recess 12 is provided about midway between its ends. This recess divides the bore but does not penetrate the interior of the container. The bore 11 is provided in a rib 17 formed longitudinally on the inside of the tubular container 10. The container has an integral end wall 13 and its other end is provided with a screw cap 14.

Around the container and fixed to it is a serrated collar 15 having its teeth directed towards one end of the container. This collar may be held in position by slipping it over the neck of the container and by screwing the container cap 14 down on to it.

Two or more containers may be placed in a hole in axial alignment with the bores 11 in alignment. Detonating cartridges located in the recesses 12 will be connected together by a detonating cord which extends through all the bores 11 and alongside the detonating cartridges to form a continuous line.

Figure 5:
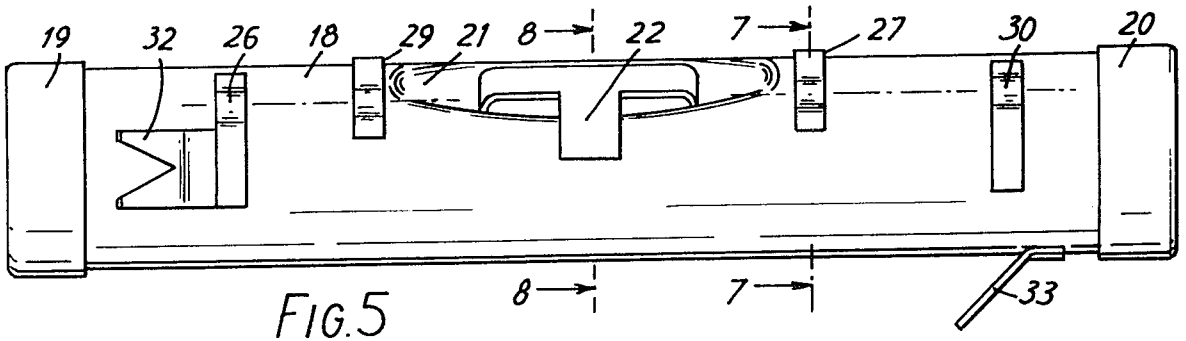
FIG. 5 is an elevational view of a modified form of container.
Figure 6:
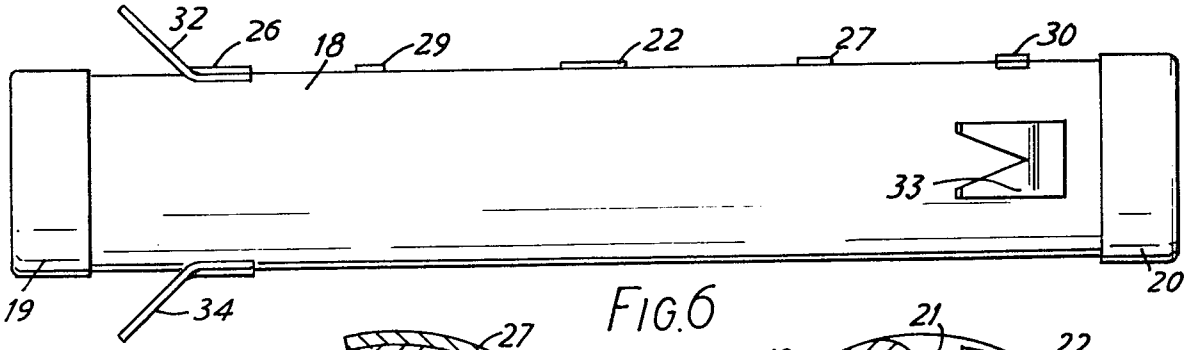
FIG. 6 is a view thereof in the direction of the arrow 6 on FIG. 5.
Figure 7:
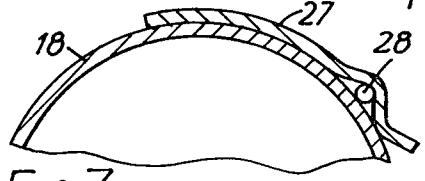
FIGS. 7 and 8 are part sectional views on the plane 7—7 and 8—8 on FIG. 5.
Figure 8:
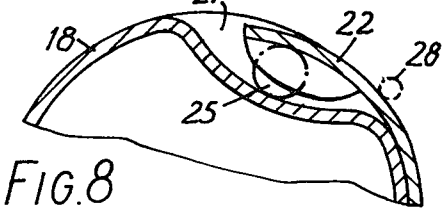

In FIGS. 5 to 8 the container 18 is a rigid circular extruded tube of plastics material about 3–5 mm wall thickness. Its ends are closed by caps 19,20 of plastics mateial which have a tight push on fit on the container. Midway between the ends of the tube it is formed with a recess 21. Extending over the recess 21 is a resilient clip 22 which is made of plastics material and is fixed by welding or adhesive to the container 18 and this serves to hold the detonating cartridge (primer) 25 is position.

Aligned with the recess on either side of it are clips 26,27,29,30 also made of plastics material and fixed to the container. These serve to hold the detonating cord 28 in position alongside the primer 25.

Similarly attached to the container 18 are several projections 32,33,34. These are of plastics material and are in the form of bifurcated strips all projecting at an angle of about 45° from the container with the furcations all pointing in the same axial direction.

The containers can be rapidly pushed down a bore hole with a plastics rod with the projections pointing up so that they will slide easily down the hole but will jam on the wall of the hole and prevent them from floating up. When a sufficient number are placed in the hole with the "Cordtex" or like detonating cord held in the clips, the hole is filled in with rock or earth and upon ignition all the charges will ignite simultaneously and will blow the rock face out laterally without blowing upwards out of the hole. The plastics containers will completely disintegrate.

Instead of using a detonating cord, it is possible to provide an electrically operated detonator with each primer cartridge and these detonators will be all connected electrically in series so that they can be ignited by current from an electric battery.

I claim:

1. A container for explosive material comprising a substantially rigid tube of plastics material, a recess in the wall of the tube between its ends large enough to house a detonating cartridge, at least two locating means of plastics material rigidly attached to the tube, at least one of said means being on each side of said recess, said means being adapted to locate a detonating line on opposite sides of said recess, and projecting resilient means of plastics material fixed to the outside of the tube and adapted to permit movement of the tube down a bore hole but to engage the walls of the hole to prevent it from floating up, and means for closing the ends of the tube, the capacity of the tube being much greater than the recess so as to be suitable for containing a main charge of explosive.

2. A container as claimed in claim 1, wherein the tube is an extruded tube, the locating means are in the form of clips attached to the outside of the tube at least one on each side of the recess, and a further clip of plastics material is fixed to the outside of the tube and extends over the recess to hold a detonating cartridge in the recess.

3. A container as claimed in claim 2, wherein the projecting means are resilient strips near both ends of the tube projecting from the tube at an angle of 30° to 60° in the same direction.

4. A container as claimed in claim 1 filled with a mixture of ammonium nitrate and oil.

5. A method of blasting out a portion of the face of a rock comprising forming a hole near a rock face, inserting into said hole a plurality of containers, said containers each comprising a substantially rigid tube of plastics material having a recess in its wall between its ends, said recess housing a detonating cartridge therein, said tube having at least two detonating line locating means of plastics material rigidly attached to the outside of the tube, at least one such locating means being on each side of said recess; connecting detonating lines to all the detonators; each of said tubes also having projecting resilient means of plastics material fixed to the outside of the tube and engaging the wall of the hole to prevent the tube from floating up; each of said tubes being filled with a mixture of ammonium nitrate and fuel oil; the ends of the tube being closed; and igniting all said detonators simultaneously thereby exploding all the mixture in all the tubes to blast out a portion of the face of the rock.

* * * * *